US005785315A

United States Patent [19]

Eiteneer et al.

[11] Patent Number: 5,785,315

[45] Date of Patent: Jul. 28, 1998

[54] MULTI-LAYERED GAMING DEVICE

[76] Inventors: Nikolai N. Eiteneer, Novokosinskaya Street 21, Apt. #164, Moscow, Russian Federation, 111672; Boris N. Eiteneer, 845 Riley Dr., Albany, Calif. 94706

[21] Appl. No.: 837,839

[22] Filed: Apr. 22, 1997

[51] Int. Cl.[6] ..... A63F 3/06

[52] U.S. Cl. ..... 273/139; 283/901; 283/903

[58] Field of Search ..... 273/139, 287; 434/348, 346; 283/101, 105, 903, 901

[56] References Cited

U.S. PATENT DOCUMENTS

| | | | |
|---|---|---|---|
| 3,055,118 | 9/1962 | Betancourt | 434/348 |
| 3,097,435 | 7/1963 | Goldschmidt | 434/348 |
| 3,110,499 | 11/1963 | Boeskool | 273/139 |
| 3,145,481 | 8/1964 | Aldershof | 434/348 |
| 3,181,252 | 5/1965 | Goldschmidt et al. | 434/348 |
| 3,287,827 | 11/1966 | Lippman | 434/348 |
| 4,033,611 | 7/1977 | Johnsen | 283/105 |
| 4,657,248 | 4/1987 | Benaim | 273/432 |
| 4,964,642 | 10/1990 | Kamille | 273/240 |
| 5,056,793 | 10/1991 | Sigle | 273/282 |
| 5,562,284 | 10/1996 | Stevens | 273/139 |

FOREIGN PATENT DOCUMENTS

| | | | |
|---|---|---|---|
| 2075918 | 11/1981 | United Kingdom | 283/903 |

*Primary Examiner*—Benjamin H. Layno
*Attorney, Agent, or Firm*—Bronson, Bronson & McKinnon

[57] ABSTRACT

The present invention provides for a multi-layered gaming device that can be used for a variety of different purposes including, but not limited to, winning prizes, education and advertising. The gaming device comprises a base panel having multiple overlapping strips removably attached to the base panel. In response to a series of questions, a user selectively removes one or more of the overlapping strips until a final image or answer is revealed.

9 Claims, 8 Drawing Sheets

MULTI-LAYERED GAMING DEVICE

FIELD OF THE INVENTION

This invention relates to the field of games. More particularly, this invention relates to games having multi-layered strips that can be selectively removed by a user to reveal an underlying image.

BACKGROUND OF THE INVENTION

Games have previously been developed to serve a multitude of different purposes including amusement, promotion, advertisement and education. Usually these games are directed to one particular purpose and are not easily transferable to a different purpose.

U.S. Pat. No. 3,110,499 to Boeskool describes a permanent reusable game device having a plurality of hinged flaps that hide an underlying sheet. By selectively lifting particular flaps, a user is able to reveal particular clues printed on a sheet. For example, the flaps may hide clues that relate to a particular item. By removing the flaps one at a time, the player must use the revealed clues to guess the item. Different games can be played by merely changing the sheet containing the clues. Unfortunately, the game device is large and expensive to manufacture. Furthermore, the device does not have multiple layers which can be selectively removed.

U.S. Pat. No. 3,181,252 to Goldschmidt describes a permanent and reusable teaching device comprising a housing for receiving a sheet and three hinged flaps. The sheets have a large picture of a particular image on the top with a list of names on the lower right corner. Adjacent to each name is a flap which conceals pictures corresponding to the names. The object of the game is to lift the flap next to the name which corresponds to the large picture at the top of the sheet. Picking the wrong name will reveal the proper image of the name chosen by the user. Unfortunately, the game device is large and expensive to manufacture. Furthermore, the device does not have multiple layers which can be selectively removed.

What is needed is a simple, inexpensive and compact gaming device that can be used for different purposes including advertising and promotion.

SUMMARY OF THE INVENTION

The present invention contemplates a multi-layered gaming device comprising a base, such as a product package, having a top side; an intermediate planar layer having a top and a bottom side and a first tab secured to the intermediate layer; and at least one top planar layer having a top side and a bottom side and a second tab secured to the top planar layer, wherein the bottom side of the intermediate layer is removably coupled to the top side of the base and the bottom side of the top planar layer is removably coupled to the top side of the intermediate layer, such that when a user pulls the first tab, the top planar layer is removed from the intermediate layer, thereby exposing the top side of the underlying intermediate layer or alternatively, when the user grasps the second tab, the adjoining layer is removed, thereby exposing the underlying base.

The present invention further contemplates a gaming device wherein the intermediate layer is removably coupled to the base layer by a first plurality of adhesive dots along a perimeter of the intermediate layer and the one or more top layers is removably coupled to the intermediate layer by a second plurality of adhesive dots along a perimeter of the one or more top layers, and further wherein the first plurality of dots comprises a greater number of dots than the second plurality of dots.

The present invention still further contemplates a multi-layered gaming device wherein material is printed on the top side of the intermediate layer and the top side of the one or more top layers to encourage the user to remove the top layer and the intermediate layer. The material can include text and/or graphics.

The multi-layered gaming device can be designed wherein the intermediate layer comprises a plurality of adjacent planar strips each having a top and a bottom side and a first tab secured thereto, wherein the bottom sides of the plurality of strips is removably coupled to the top of the base layer. The multi-layered gaming device can also be designed wherein the one or more top layers comprises a plurality of adjacent strips each having a top and bottom side and a second tab secured thereto, wherein the bottom sides of the plurality of strips is removably coupled to the top of the intermediate layer.

In another embodiment, the present invention provides for a multi-layered gaming device comprising a base having a top side; an intermediate planar layer removably coupled to the top side of the base, the intermediate layer comprising a plurality of adjacent intermediate strips each having a tab connected thereto for facilitating removal of the corresponding intermediate strip, wherein each intermediate strip has a top and a bottom side and further wherein a portion of a complete image is printed on the top side of each of the intermediate strips; and at least one top planar layer removably coupled to the top side of the intermediate layer, the top layer comprising a plurality of adjacent top strips which correspond to the underlying intermediate strips, each top strip having a tab connected thereto for facilitating removal of the corresponding top strip, each top strip having a top side and a bottom side, the top side of each of the top strips having a portion of a complete image printed thereupon, wherein a user can selectively remove particular combinations of top or intermediate strips to create various combinations of a composite image.

DETAILED DESCRIPTION OF THE PREFERRED EMBODIMENTS

The present invention provides for a multi-layered gaming device that can be used for a variety of different purposes including, but not limited to, winning prizes, education, advertising and promotion.

The basic embodiment of the present invention includes a base having an intermediate layer coupled thereto and one or more top layer at least partially overlapping the intermediate layer. The intermediate layer and one or more top layers can each be made up of one or more different strips. The base and removable strips can have any size, although they preferably have length and width dimensions less than 6 inches by 6 inches. Furthermore, the base and removable strips can be made of almost any material including, but not limited to, paper, cardboard, plastic, or composites. Still further, the strips can be coupled to each other and to the base panel by any well known means including, but not limited to, glue, staples, thread or perforated edges between the strips and a substrate. By removable, the layers do not have to be completely removable, but can also be partially removed so that they are still connected at one edge.

A series of different printed material such as text questions, symbols or graphics are printed on or next to the overlapping strips. Tabs are coupled to the strips for facilitating removal of the strips and may also be printed with different material such as responses or answers to particular question currently exposed to a user. The user removes particular strips by pulling the tabs that correspond to the user's chosen answer. The user continues removing tabs until a final image or message is revealed. The number of tabs the user removes depends on the particular answers chosen.

The present invention can be provided to a user in a number of different ways depending on the particular application. For example, the device can be attached to a commercial product (i.e. food packages such as cereal boxes, cookie boxes or drink containers), provided with a commercial product (i.e. within a cereal box) or can be sold or given away independently. The present invention can also be designed as sports or entertainment trading cards.

While the present invention will be described in detail by way of illustration and example, for purposes of clarity, it will be understood by those skilled in the art that certain changes and modifications may be made to the described embodiments without departing from the spirit of the invention and scope of the appended claims. For example, the geometry of the elements, as well as constituent materials can vary in accordance with the nature of the product, compatibility, ease of manufacturing and attachments, etc.

Figure 1A:
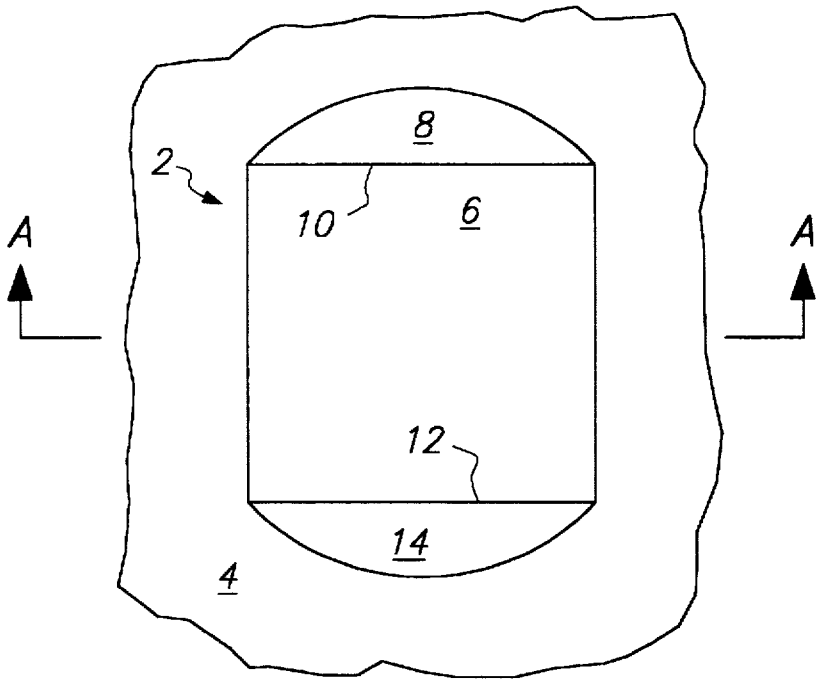
FIGS. 1*a–c* illustrate top views of the different layers of the present invention.
Figure 1B:
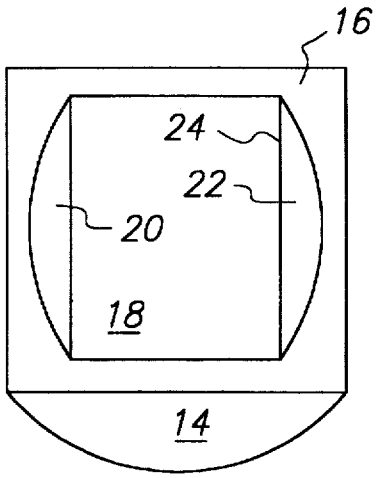
Figure 1C:
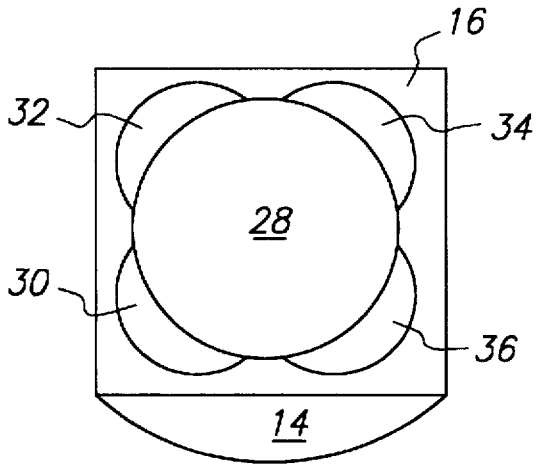
Figure 2:
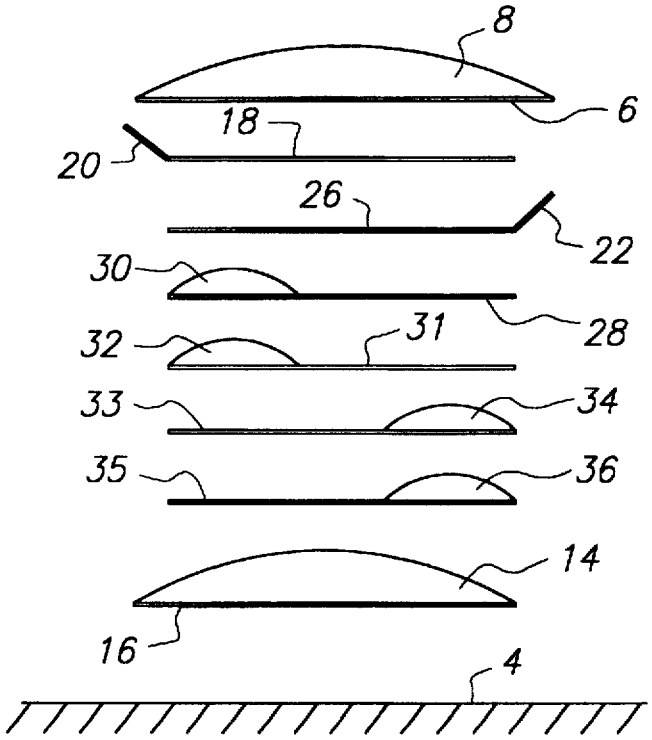
FIG. 2 illustrates an exploded side view of the embodiment illustrated in FIG. 1.

Turning now to the figures, FIGS. 1 and 2 illustrate the basic configuration of the present invention. FIG. 1*a* illustrates a top view of a gaming device 2 of the present invention coupled to a substrate 4 (i.e. base). Substrate 4 can be made of almost any material including, but not limited to, paper, cardboard, plastic, metal and wood. Substrate 4 can also be mounted to a product such as a cereal box, cookie box, or drink container (not shown), or be part of the product. Gaming device 2 comprises multiple layers which are removably coupled to each other. Because this example only has one strip per layer, the terms "strip" and "layer" are interchangeable for this example. FIG. 1*a* illustrates the top most rectangular strip 6 having a tab 8 coupled at edge 10. Tab 8 can either be integrally formed with rectangular strip 6 or be coupled to rectangular strip 6 using any well known means. Adjacent to edge 12 is tab 14 which extends from the bottom most rectangular strip 16 located below rectangular strip 6 and described in more detail with reference to FIG. 1*b*. By grasping tab 8, a user is able to remove rectangular strip 6 revealing the portion of the gaming device 2 illustrated in FIG. 1*b*.

FIG. 1*b* illustrates the rectangular strip 16 and tab 14 mounted below rectangular strip 6 and to the substrate 4. Rectangular strip 16 and tab 14 are manufactured of the same material as and configured similarly to the top most rectangular strip 6 and corresponding tab 8. Mounted to the top surface of the rectangular strip 16 are two additional rectangular strips 18 and strip 26 (not shown). Illustrated in FIG. 1*b* is a rectangular strip 18 and corresponding tab 20. Both rectangular strip 18 and tab 20 are manufactured of the same material as and configured similarly to the top most rectangular strip 6 and corresponding tab 8. Adjacent to edge 24 of rectangular strip 18 is tab 22 which extends from strip 26 located below strip 18. A user reveals strip 26 by grasping tab 20 and removing rectangular strip 18. By grasping tab 22, a user is able to remove rectangular strip 26 revealing circular strip 28 and tabs 30–36 which are all mounted to rectangular strip 16 (see FIG. 1*c*). Instead of individually removing rectangular strip 18 and rectangular strip 26, a user can merely grasp tab 22 and remove both rectangular strips 18 and 26. This is because rectangular strip 18 is mounted on top of rectangular strip 26.

FIG. 1*c* illustrates circular strip 28 and tabs 30, 32, 34 and 36. Circular strip 28 and tabs 30–36 are manufactured of the same material as and configured similarly to the top most rectangular strip 6 and corresponding tab 8. Tab 30 is coupled to circular strip 28 and tabs 32, 34 and 36 are coupled to circular strips 31, 33 and 35 respectively (see FIG. 1*d*). By grasping one of tabs 30, 32, 34 or 36, a user is able to remove circular strip 28; circular strips 28 and 31; circular strips 28, 31 and 33; or circular strips 28, 31, 33, and 35; respectively.

FIG. 2 illustrates an exploded side view of the gaming device 2 along the line A—A shown in FIG. 1*a*. This figure is self-explanatory and illustrates the layering of the different strips described in FIGS. 1*a–c*.

FIGS. 3*a–d* illustrate an example method of mounting the different strips to each other and to the substrate. It is important for the effective operation of the present invention that the strips be secured to each other with increasing strength from the top most strip 6 to the bottom most strip 2. In other words, the top most layer must be easier to remove than the layer directly below it. This allows the user to selectively remove only one layer at a time. For simplicity's sake, FIGS. 3*a–d* only describe the mounting procedure for particular layers.

Figure 3A:
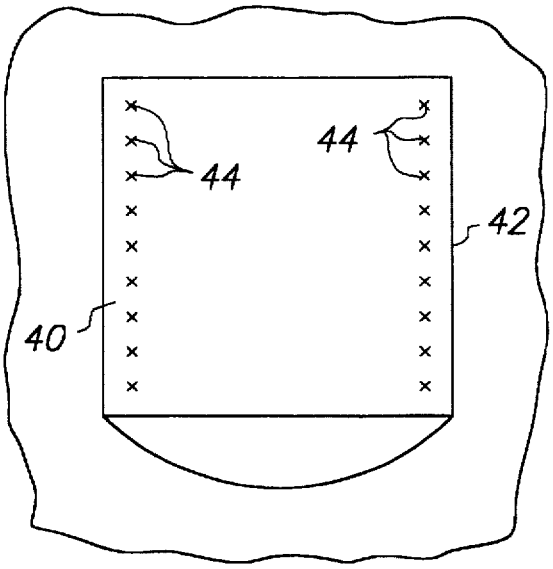
FIGS. 3*a–d* illustrate an example method of removably mounting each strip to one another.
Figure 3B:
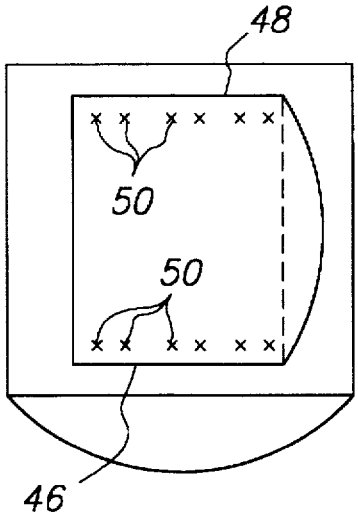
Figure 3C:
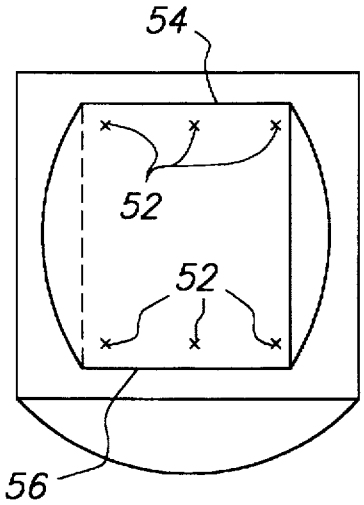
Figure 3D:
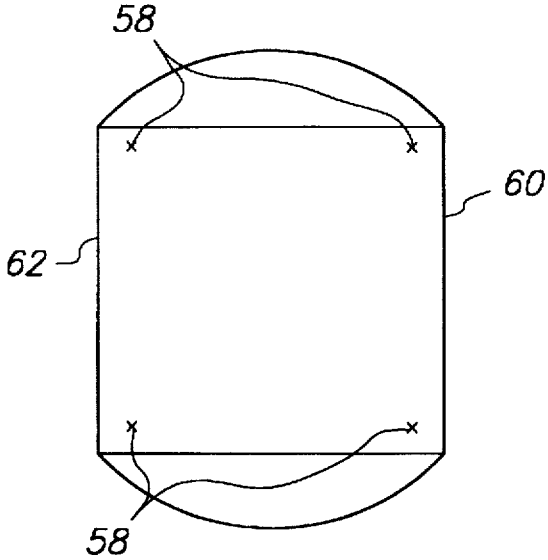

Starting from the bottom, the bottom most rectangular strip 16 can be securely mounted to the substrate 4 by placing adhesive dots 44 along the left and right edges 40 and 42. FIG. 3*b* illustrates strip 26 as being mounted to strip 16 by means of adhesive dots 50 along the top and bottom edges 46 and 48. FIG. 3*c* illustrates strip 18 mounted to strip 26 by means of a plurality of adhesive dots 52 along the top and bottom edges 54 and 56. Finally, FIG. 3*d* illustrates strip 6 mounted to strip 18 by means of a plurality of adhesive dots 58 along the left and right edges 60 and 62. In order for each strip to be easier to remove than the strips below it, a greater number of adhesive dots are used when going from top to bottom. Therefore, adhesive dots 44 represent a greater number of dots than adhesive dots 48 which in turn represents a greater number of dots than adhesive dots 54, etc. Alternatively, adhesive with a greater strength can be used for each successive layer going from top to bottom.

Although not illustrated, each strip can be removably coupled to each other and to the substrate using perforations. This can be accomplished, for example, in a manner similar to how tissue box openings are initially sealed. Any other means for removably coupling the layered strips can also be used.

Figure 4A:
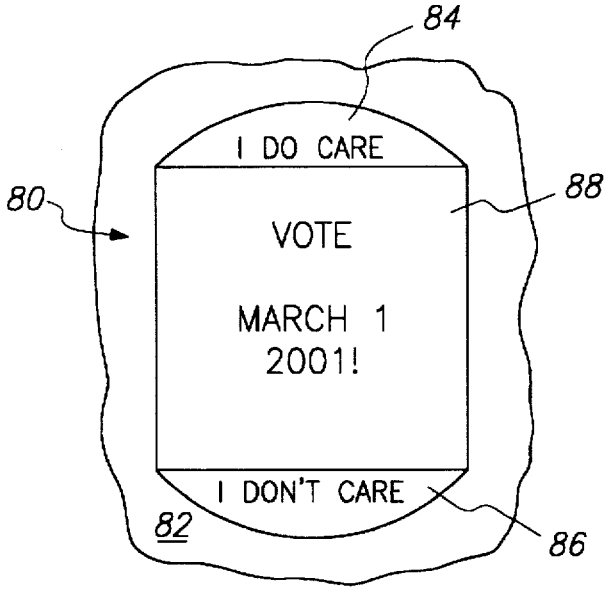
FIGS. 4*a–e* illustrate an example application of the embodiment illustrated in FIG. 1.
Figure 4B:
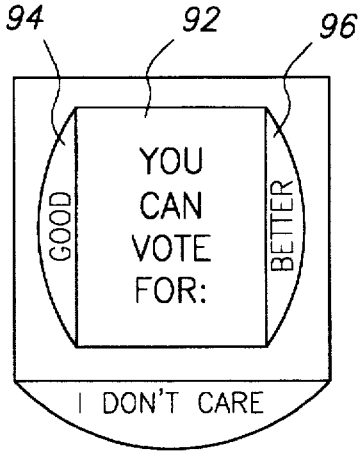
Figure 4C:
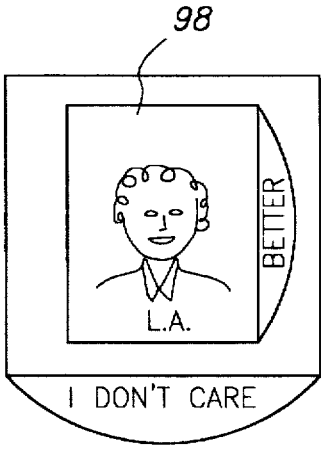
Figure 4D:
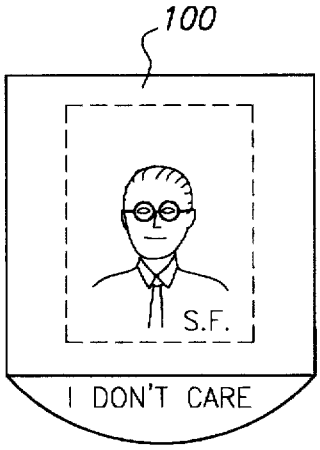
Figure 4E:
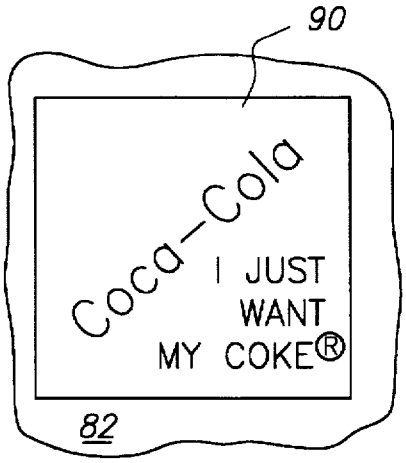
Figure 5A:
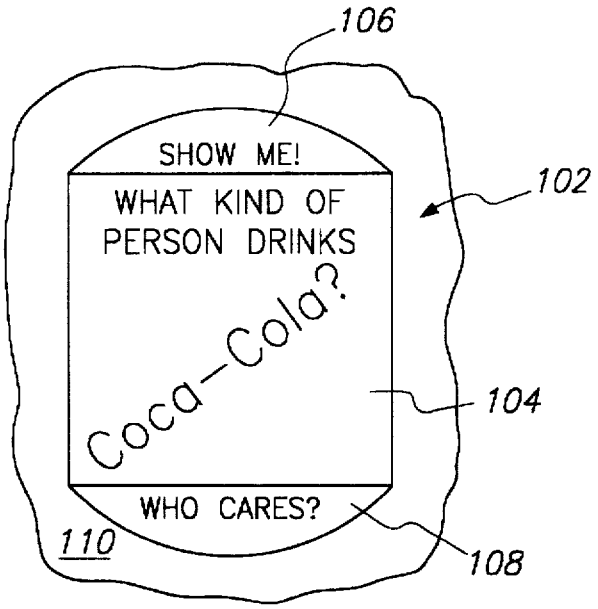
FIGS. 5*a–g* illustrate another example application of the embodiment illustrated in FIG. 1.
Figure 5B:
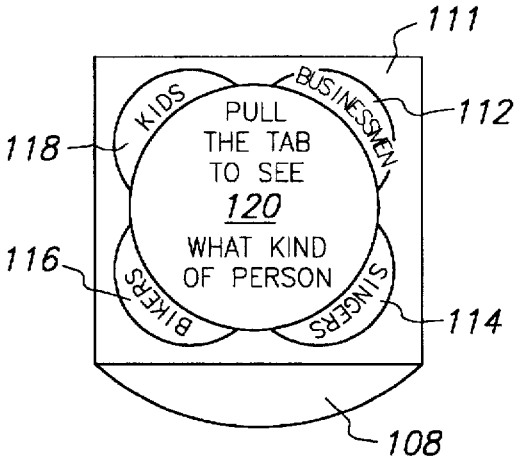
Figure 5C:
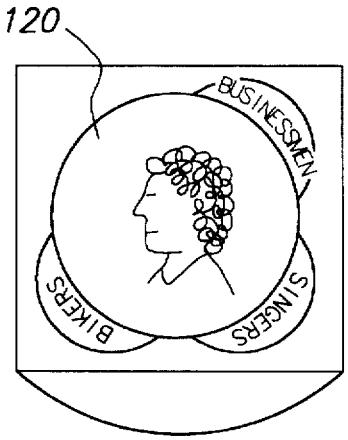
Figure 5D:
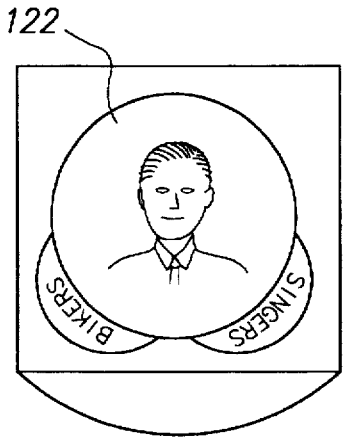
Figure 5E:
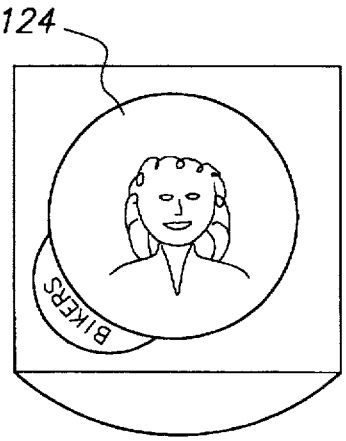
Figure 5F:
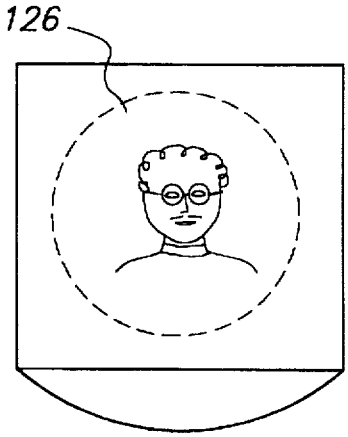
Figure 5G:
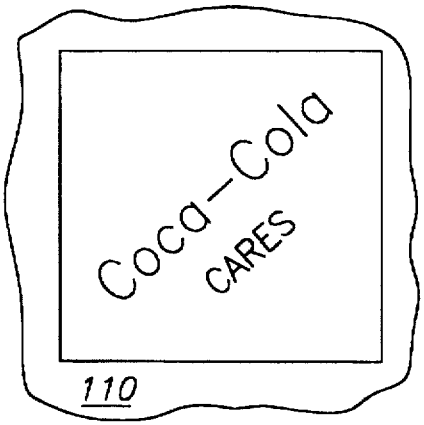

FIGS. 4a–e illustrate an example application of the gaming device of the present invention. FIG. 4a illustrates a complete gaming device 80 attached to a substrate 82 which can be a rectangular voting flyer made from paper or cardboard. Initially, a viewer sees the top most strip 88 which informs the viewer that he or she should vote on Mar. 1, 2001. The two tabs 84 and 86 allow the viewer to reply with "I do care" or "I don't care," respectively. If the viewer pulls tab 86 marked "I don't care," all of the layered strips are removed and an advertisement for Coca-Cola® 90 is revealed on the substrate 82.

If the viewer does care, he can pull tab 84 which is coupled to top most strip 88. This will result in only strip 88 being removed. Strip 92 and two tabs 94 and 96 below (see FIG. 4b) are consequently revealed. They inform the viewer that he or she can vote for the good candidate (tab 94) or the better candidate (tab 96). Pulling tab 94 reveals a good candidate on strip 98 (see FIG. 4c) and pulling tab 96 reveals a better candidate on strip 100 (see FIG. 4c). If the viewer desires, he or she can then remove the last remaining tab 86 to view the advertisement for Coca-Cola® 90 on the substrate 82.

FIG. 5 illustrates another example application of the gaming device of the present invention. FIG. 5a illustrates a complete gaming device 102 attached to a substrate 110 wherein the substrate 110 can be a rectangular advertising flyer made from paper or cardboard. Initially a viewer sees the top most strip 104 which asks the question, "what kind of person drinks Coca-Cola®?" The two tabs 106 and 108 allow the viewer to reply with "show me" or "who cares?," respectively. If the viewer pulls tab 108 marked "who cares?" all of the layered strips are removed and an image saying "Coca-Cola® cares," is revealed on the substrate 82.

If the persons wants to see what types of persons drink Coca-Cola®, he or she can pull tab 106 which is coupled to top most strip 104, thereby only removing strip 104. This reveals strip 120 that asks the viewer to "pull the tab to see what type of person." Also revealed are the four tabs 112, 114, 116 and 118 which identify four types of drinkers: "businessmen," "singers," "bikers," and "kids." FIGS. 5c–5f illustrate images of the different types of Coca-Cola® drinkers depending on which tab is removed. If the viewer desires, he or she can then remove the last remaining tab 108 to view the advertisement for Coca-Cola® on the substrate 110.

Figure 6:
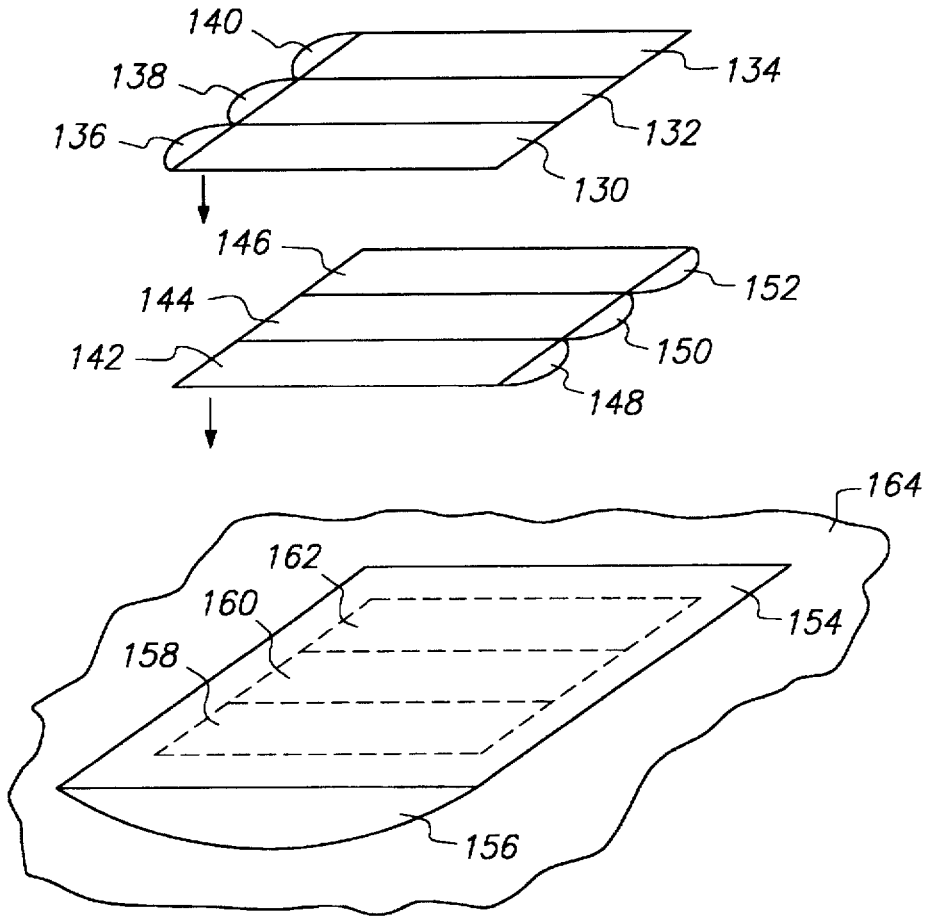
FIG. 6 illustrates another embodiment of the present invention.
Figure 7A:
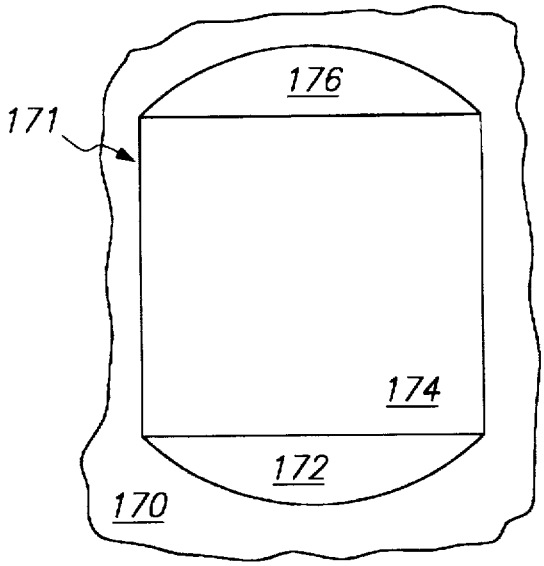
FIGS. 7*a–g* illustrate an example application of the embodiment illustrated in FIG. 6.
Figure 7B:
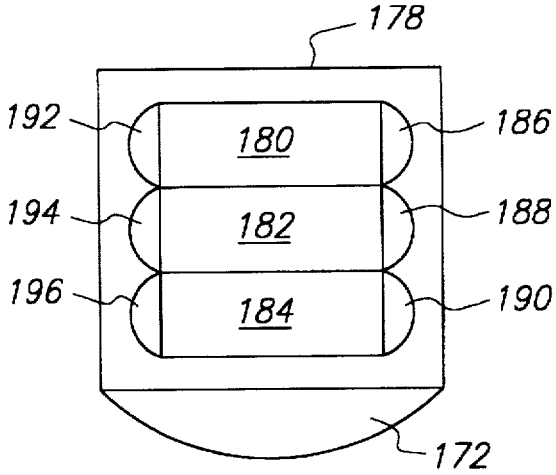
Figure 7C:
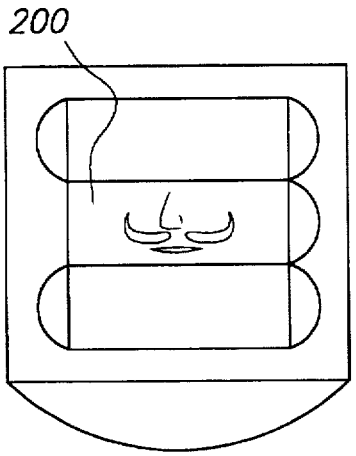
Figure 7D:
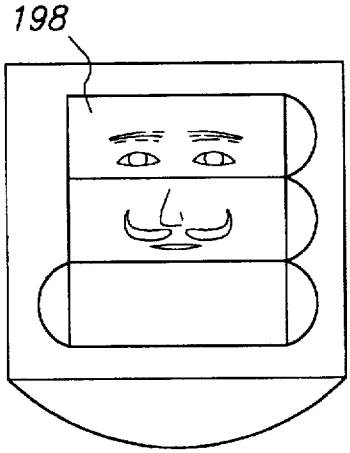
Figure 7E:
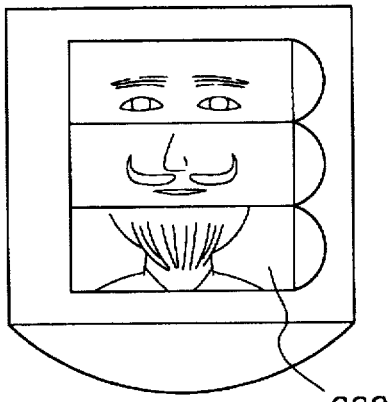
Figure 7F:
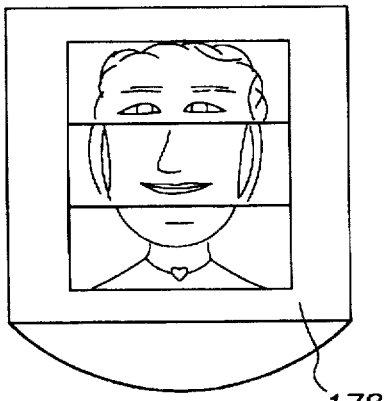
Figure 7G:
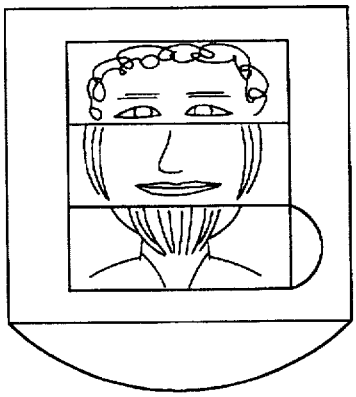
Figure 8A:
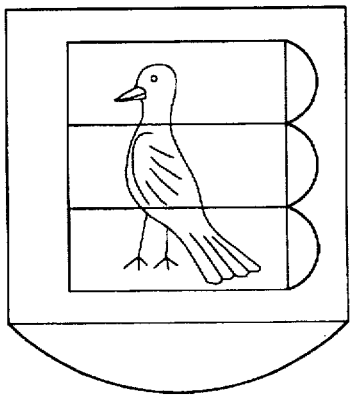
FIG. 8 illustrates another example of the embodiment illustrated in FIG. 6.
Figure 8B:
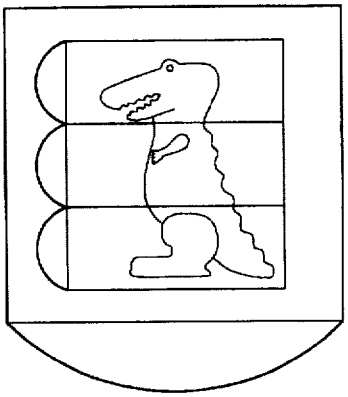
Figure 8C:
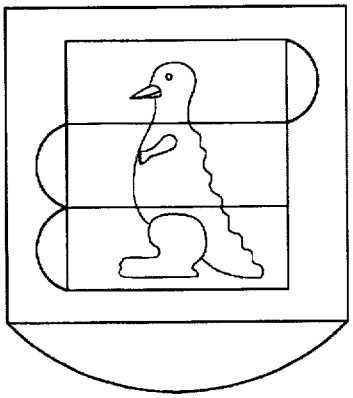
Figure 9A:
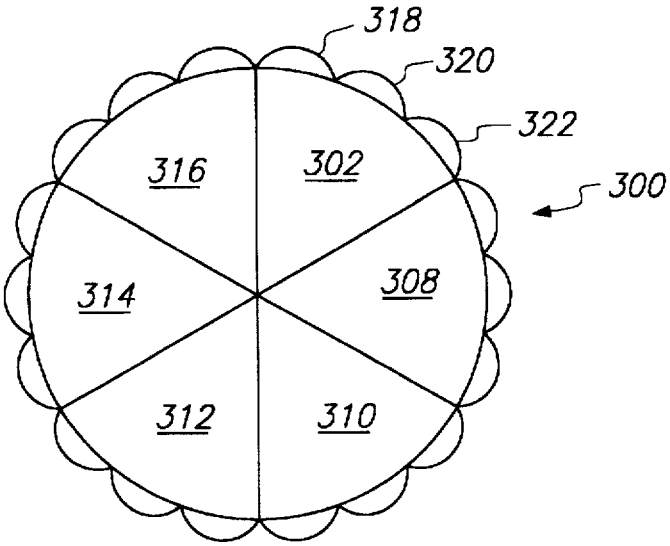
FIGS. 9*a–e* illustrate another embodiment of the present invention.
Figure 9B:
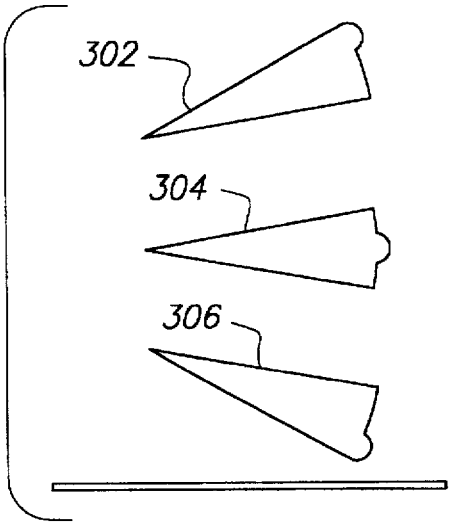
Figure 9C:
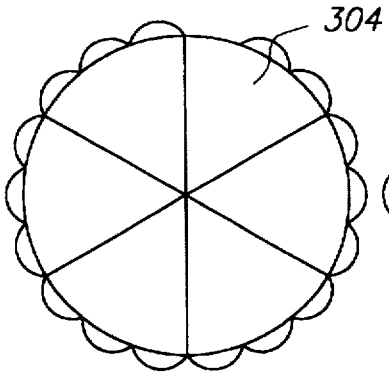
Figure 9D:
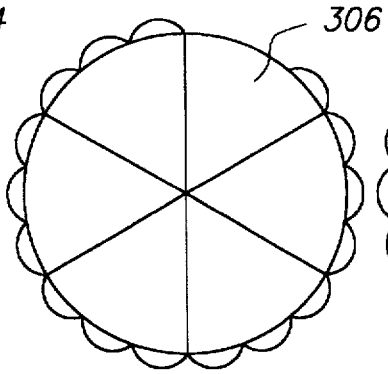
Figure 9E:
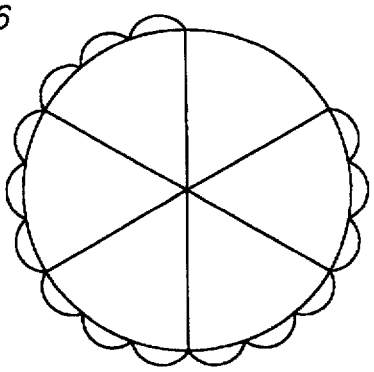

FIGS. 6–8 illustrate an exploded view of another embodiment of the present invention. The basic concept of this embodiment is similar to the first embodiment, however, the two layers 131 and 141 are each comprised of multiple adjacent strips 130, 132 and 134; and 148, 150 and 152; respectively. This embodiment comprises a substrate 164 (i.e. base) which may be similar to substrate 110 described above with reference to FIG. 5. Coupled to the top of the substrate 164 is a bottom most strip 154 having a tab 156. Dotted areas 158, 160 and 162 are where the middle strips 142, 144 and 146 are removable coupled to the bottom most strip 154. Tabs 148, 150 and 152 are coupled to the right edges of middle strips 142, 144 and 146 for removing middle strips 142, 144 and 146 from the bottom most strip 154. Top most strips 130, 132 and 134 are removably coupled on top of middle strips 142, 144 and 146 such that the middle strips are parallel to the top most strips. Tabs 136, 138 and 140 are coupled to the left edges of strips 130, 132 and 134 such that tabs 136, 138 and 140 do not overlap tabs 148, 150 and 152.

FIG. 7 illustrates an example application of the embodiment described with reference to FIG. 6, wherein a user can create different composite faces with different facial features. FIG. 7a illustrates the complete gaming device 171 coupled to substrate 170 wherein the gaming device includes a top most strip 174 and tabs 172 and 176. By grasping tab 176, a user is able to remove the top most strip 174 to reveal a plurality of first middle strips 180, 182 and 184 on top of the bottom most strip 178, as shown in FIG. 7b. Tabs 192, 194 and 196 are coupled to the layer of first middle strips 180, 182 and 184, respectively. FIGS. 7c–e illustrate that by removing the first middle strips 180, 182 and 184, the user is able to reveal a lower layer of second middle strips 198, 200 and 202 coupled to tabs 186, 188 and 190, respectively. Furthermore, a set of male eyes are printed on strip 198 while a male nose is printed on strip 200 and a male mouth is printed on strip 202. Finally, the bottom most strip 178 has a female face positioned beneath the lower layer of middle strips 198, 200 and 202. By removing selected strips, a user is able to create a face having different composite facial features. For example, FIG. 7g illustrates a face wherein all of the strips are removed except for strip 202. The resulting image includes female eyes and nose but a male mouth.

FIG. 8 illustrates another example application wherein the two images are a bird and a standing alligator. By removing particular strips, the user can create an accurate image of the bird or alligator, or a composite of the two animals. This can be used to either create fanciful animals or to teach children what specific animals look like. Furthermore, this effect can be used with text, in addition to graphics, to create words, sentences or phrases.

FIG. 9 illustrates that the present invention can incorporate strips having almost any shape or configuration without departing from the scope of the present invention. For example, FIG. 9a illustrates a gaming device 300 in the shape of a whole pie with six strips 302, 308, 310, 312, 314 and 316 in the shape of pie pieces. FIG. 9b illustrates that each pie pieces contains three layers, a top most strip 302, a middle strip 304 and a bottom most strip 306. Furthermore, each strip is coupled to a tab for facilitating the removal of the strips. For example, strip 302 is coupled to tab 318 strip 304 is coupled to tab 320 and strip 306 is coupled to tab 322. FIGS. 9c–9e illustrate the pie after tabs 302, 304 and 306 are removed, respectively.

We claim:

1. A multi-layered gaming device comprising:

a) a base having a top side;

b) an intermediate planar layer having a top and a bottom side and a first tab secured to the intermediate layer; and c) at least one top planar layer having a top side and a bottom side and a second tab secured to the top planar layer, wherein the bottom side of the intermediate layer is removably coupled to the top side of the base and the bottom side of the top planar layer is removably coupled to the top side of the intermediate layer, said first tab and said second tab are simultaneously exposed, wherein a user can selectively pull either the first tab or the second tab, such that when a user pulls the second tab, the top planar layer is removed from the intermediate layer, thereby exposing the top side of the underlying intermediate layer or alternatively, when the user pulls the first tab, the adjoining layer is removed, thereby exposing the underlying base.

2. The multi-layered gaming device of claim 1 wherein the intermediate layer is removably coupled to the base layer by a first plurality of adhesive dots along a perimeter of the intermediate layer and the one or more top layers is removably coupled to the intermediate layer by a second plurality of adhesive dots along a perimeter of the one or more top layers, and further wherein the first plurality of dots comprises a greater number of dots than the second plurality of dots.

3. The multi-layered gaming device of claim 1 wherein material is printed on the top side of the intermediate layer and the top side of the one or more top layers to encourage the user to remove the top layer and the intermediate layer.

4. The multi-layered gaming device of claim 3 wherein the material comprises graphics.

5. The multi-layered gaming device of claim 3 wherein the material comprises text.

6. The multi-layered gaming device of claim 1 wherein the intermediate layer comprises a plurality of adjacent planar strips each having a top and bottom side and a first tab secured thereto, wherein the bottom sides of the plurality of strips is removably coupled to the top of the base layer.

7. The multi-layered gaming device of claim 1 wherein at least one of the one or more top layers comprises a plurality of adjacent strips each having a top and bottom side and a second tab secured thereto, wherein the bottom sides of the plurality of strips is removably coupled to the top of the intermediate layer.

8. The multi-layered gaming device of claim 1 wherein the base is a product package.

9. A multi-layered gaming device comprising:

a) a base having a top side;

b) an intermediate planar layer removably coupled to the top side of the base, the intermediate layer comprising a plurality of adjacent intermediate strips each having a first tab connected thereto for facilitating removal of the corresponding intermediate strip, wherein each intermediate strip has a top and a bottom side and further wherein a portion of a complete image is printed on the top side of each of the intermediate strips; and c) at least one top planar layer removably coupled to the top side of the intermediate layer, the top layer comprising a plurality of adjacent top strips which correspond to the underlying intermediate strips, each top strip having a second tab connected thereto for facilitating removal of the corresponding top strip, each top strip having a top side and a bottom side, the top side of each of the top strips having a portion of a complete image printed thereupon, said first tabs and said second tabs are simultaneously exposed, wherein a user can selectively pull combinations of either the first tabs or the second tabs thereby removing particular combinations of top or intermediate strips to create various combinations of a composite image.

* * * * *